US005916246A

United States Patent [19]

Viegas et al.

[11] Patent Number: 5,916,246

[45] Date of Patent: Jun. 29, 1999

[54] SYSTEM AND METHOD FOR TRANSFERRING LIQUID CARBON DIOXIDE FROM A HIGH PRESSURE STORAGE TANK TO A LOWER PRESSURE TRANSPORTABLE TANK

[75] Inventors: Herman H. Viegas, Bloomington; Gary W. Wojciechowski, Minneapolis; Mark J. Buenz, Savage; Girma G. Desta, Richfield, all of Minn.

[73] Assignee: Thermo King Corporation, Minneapolis, Minn.

[21] Appl. No.: 08/955,711

[22] Filed: Oct. 23, 1997

[51] Int. Cl.[6] ..... F17C 7/02

[52] U.S. Cl. ..... 62/50.1; 62/49.1

[58] Field of Search ..... 62/49.1, 50.1

[56] References Cited

U.S. PATENT DOCUMENTS

| | | | |
|---|---|---|---|
| 3,754,407 | 8/1973 | Tyree, Jr. | 62/50.1 |
| 3,797,263 | 3/1974 | Shahir et al. | 62/49.1 X |
| 3,946,572 | 3/1976 | Bragg | 62/49.1 X |
| 4,100,759 | 7/1978 | Tyree, Jr. | 62/50.1 |
| 4,592,205 | 6/1986 | Brodbeck et al. | 62/49.1 |
| 4,887,857 | 12/1989 | VanOmmeren | 62/49.2 X |
| 5,177,974 | 1/1993 | Uren et al. | 62/49.2 X |
| 5,259,198 | 11/1993 | Viegas et al. | 62/7 |
| 5,267,443 | 12/1993 | Roehrich et al. | 62/50.3 |
| 5,267,446 | 12/1993 | Viegas et al. | 62/50.2 |
| 5,285,644 | 2/1994 | Roehrich et al. | 62/50.3 |
| 5,287,705 | 2/1994 | Roehrich et al. | 62/50.3 |
| 5,305,825 | 4/1994 | Roehrich et al. | 165/64 |
| 5,311,927 | 5/1994 | Taylor et al. | 165/64 |
| 5,315,840 | 5/1994 | Viegas et al. | 62/167 |
| 5,320,167 | 6/1994 | Johnson et al. | 165/64 |
| 5,365,744 | 11/1994 | Viegas et al. | 62/50.3 |
| 5,458,188 | 10/1995 | Roehrich et al. | 165/64 |

*Primary Examiner*—Christopher B. Kilner
*Attorney, Agent, or Firm*—Michael M. Gnibus

[57] ABSTRACT

Both an system and method are provided for transferring liquid carbon dioxide from a storage tank pressurized at 300 psi to a truck-transportable tank pressurized at about 110 psi. The system includes an inlet conduit having a hose portion connected between the storage and transportable tanks for conducting a flow of liquid carbon dioxide therebetween, and a vent hose connected to the transportable tank for venting gaseous carbon dioxide. Pressure regulators are connected to the inlet and vent hoses, respectively. In operation, the pressure regulator connected to the inlet conduit reduces the pressure of the flow of liquid carbon dioxide entering the transportable tank from 300 psi to 175 psi, while the pressure regulator connected to the vent conduit maintains a back pressure of 110 psi in the transportable tank while the allowing the venting of gaseous carbon dioxide. Automatic shut-off and purging mechanisms are provided for shutting off the flow of liquid carbon dioxide when the transportable tank is filled, and purging the inlet hose. A muffler is connected to the outlet of the vent hose for reducing the noise associated with the venting of gaseous carbon dioxide. The system allows an operator to easily and automatically fill a transportable cryogenic storage tank with liquid carbon dioxide with a minimum amount of waste and noise.

24 Claims, 1 Drawing Sheet

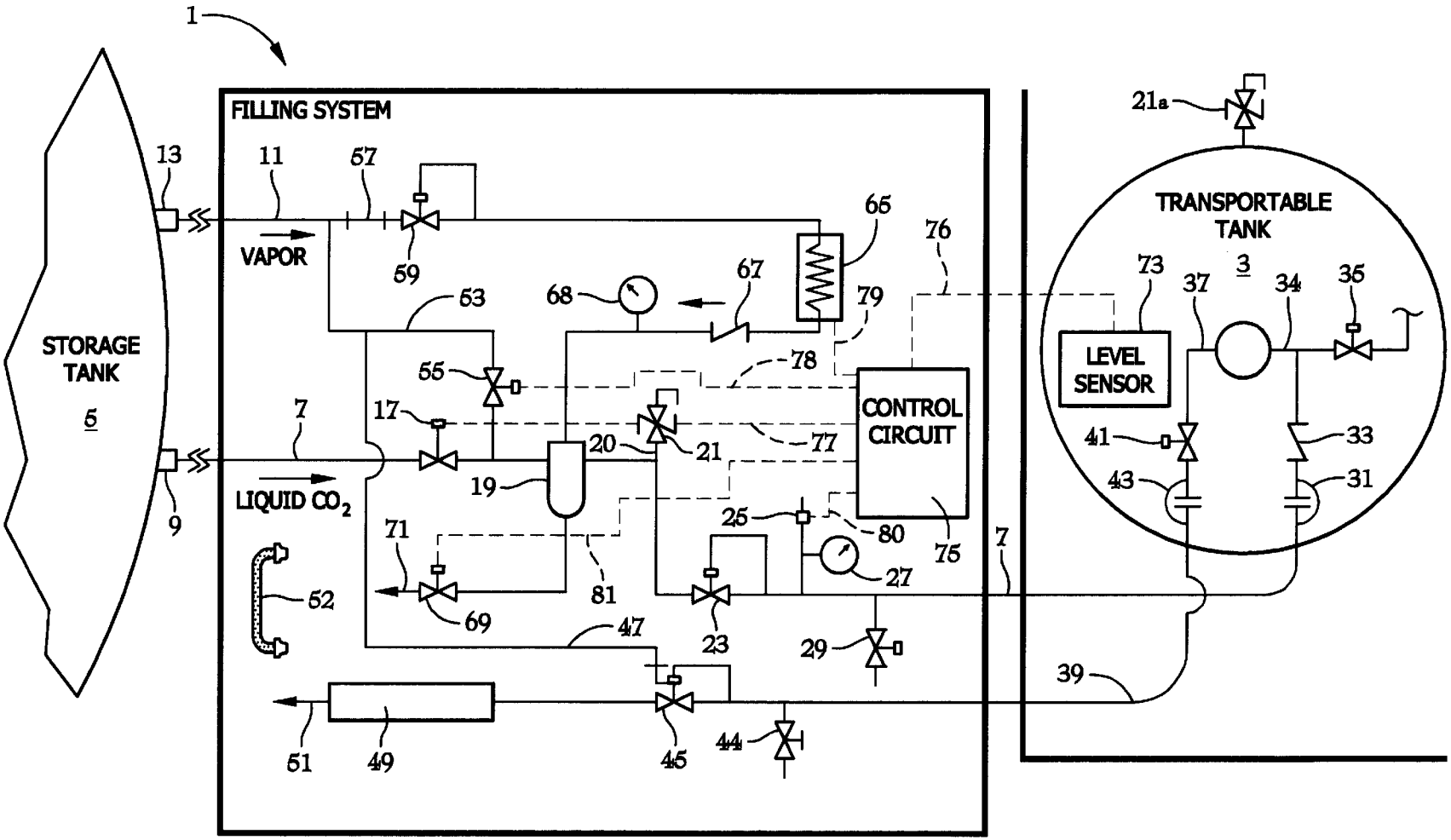
FIGURE

SYSTEM AND METHOD FOR TRANSFERRING LIQUID CARBON DIOXIDE FROM A HIGH PRESSURE STORAGE TANK TO A LOWER PRESSURE TRANSPORTABLE TANK

BACKGROUND OF THE INVENTION

This invention generally relates to a system and method for automatically transferring a cryogen, such as liquid carbon dioxide, from a higher pressure storage pressure tank to a lower pressure transportable tank without the need for continuous, manual adjustments of flow control valves.

Air conditioning and refrigeration systems of the type used to cool the loads of trucks and tractor-trailers conventionally utilize a chloroflurocarbon (CFC) refrigerant and a mechanical refrigeration cycle. Because of the suspected depleting affects of CFCs of stratospheric ozone ($O_3$), practical alternatives to the use of CFCs in such refrigeration systems are being sought. One such alternative is a cryogenic refrigeration system utilizing either liquid carbon dioxide or liquid nitrogen. Such a system is particularly attractive because, in addition to eliminating the need for CFC refrigerants, it also eliminates the need for a refrigerant compressor and the diesel engine or other prime mover that drives it. An example of such a cryogenic refrigeration system that is designed for use with liquid carbon dioxide is described and claimed in U.S. patent application Ser. No. 08/501,372, filed Jul. 12, 1995, and assigned to the Thermo King Corporation.

When such cryogenic refrigeration systems are used to cool the contents of a truck or tractor-hauled trailer, they are powered by means of a transportable storage tank that is small enough to be easily hauled by the vehicle, yet large enough to contain enough liquid cryogen to keep the contents of the truck or trailer cool for a practical length of time. Ideally, the liquid carbon dioxide within the transportable tank is maintained at a pressure of approximately 110 psi, which keeps the cryogen at a temperature of approximately −50° F. Liquid carbon dioxide maintained at these conditions is well suited for transportable refrigeration applications as it has a relatively large heat absorption capability in combination with a high density. However, liquid carbon dioxide that is manufactured and stored in large storage tanks is maintained at higher pressures on the order to 250 psi to 300 psi, and higher temperatures on the order of 0° F. to −10° F. Liquid carbon dioxide maintained at these conditions has a relatively smaller heat absorption capability and lower density. Hence if the liquid carbon dioxide is to be optimally used, it must undergo a substantial pressure drop (300 psi versus 110 psi) when it is loaded from a storage tank to the tank of a transportable cryogenic refrigeration system.

In the prior art, in order to fill the tank of a transportable cryogenic system from a storage tank, it was necessary for the system operator to install an inlet conduit between the storage tank and the transportable tank, and a vent conduit to a vent opening in the transportable tank. Flow valves and pressure sensors were provided in both the inlet conduit and the vent conduit. During a filling operation, it was necessary for the system operator to continuously manipulate the fill valve and the vent valve while observing pressure gauges in order to fill the transportable tank from the storage tank at a pressure of approximately 110 psi to optimize the cryogenic properties of the liquid carbon dioxide.

However, the applicants have observed a number of risks and shortcomings associated with such a tank filling technique. For example, it is important that the pressure of the liquid or liquid/vapor mixture in the system not fall below the triple point for $CO_2$. At or near this point, a solid-liquid mixture (slush) begins to form and this can cause blockage of the lines. Solid $CO_2$ is generally referred to as dry ice. Dry ice in the fill hose can block the flow of liquid carbon dioxide, while dry ice in the transportable tank renders the cryogenic system inoperative until the carbon dioxide becomes reliquified. The reliquification process is always tedious and lengthy, and can take as long as several days if the inner vessel of the transportable tank is made of mild steel rather than stainless steel, since the −110° F. temperature of dry ice can embrittle mild steel to a point where it can rupture if the transportable tank is suddenly repressurized. The filling of the transportable tank at too high a pressure can blow out safety devices such as over-pressure disks mounted in the walls of the vehicle tank.

Because of the necessity of maintaining a proper pressure range, prior art filling systems require a trained and experienced system operator to continuously manipulate both the fill and vent valves during a filling operation while monitoring the pressure of the transportable tank. Such an operator must also be able to accurately estimate when the transportable tank is full, since the overfilling of such a tank can also cause unwanted dry ice formation in both the transportable tank and the inlet conduit. The operator must also manually purge the fill hose of liquid carbon dioxide after the filling operation is complete to avoid the formation of potentially obstructive dry ice. Finally, the applicants have observed that the continuous venting of gaseous carbon dioxide generated by the pressure differential between the storage tank and the transportable tank causes a continuous loud "screaming" sound that necessitates of ear protection of not only the operator, but of all persons in the immediate vicinity of the filling operation.

Clearly, what is needed is a system for transferring liquid carbon dioxide from a high pressure storage tank to a lower pressure transportable tank which can perform a filling operation automatically, thereby obviating the need for continuous valve manipulation and gauge monitoring by an experienced operator. Ideally, such a system would also include some sort of means for automatically shutting off the filling operation when the transportable tank attained a full condition so as to prevent overfilling and the unwanted formation of dry ice in the tank and filling hose. It would also be desirable if such a system includes some sort of means for automatically purging the filling hose at the termination of a filling operation in order to prevent not only the unnecessary wastage of liquid cryogen, but the unwanted formation of dry ice in this hose. Finally, such a system should have some sort of means for reducing the noise generated by the continuous venting of gaseous carbon dioxide so as to obviate the need for ear protection in the vicinity of the filling operation.

The foregoing illustrates limitations known to exist in present systems for transferring liquid carbon dioxide from a high pressure storage tank to a lower pressure transportable tank. Thus it would be advantageous to provide an alternative directed to overcoming one or more of those limitations. Accordingly, a suitable alternative is provided including features more fully disclosed hereinafter.

SUMMARY OF THE INVENTION

Generally speaking, the invention is a system and method for transferring a cryogen, such as liquid carbon dioxide from a high pressure storage vessel pressurized at about 300 psi to a lower pressure transportable vessel pressurized at about 110 psi, that overcomes all the shortcomings associated with the prior art. The system comprises an inlet conduit and associated relief valve activated at a selected pressure connected between the higher pressure storage and lower pressure transportable vessels for conducting a flow of liquid cryogen, such as carbon dioxide, during a filling operation; a vent conduit connected to the transportable vessel for venting gaseous cryogen, such as carbon dioxide created as a result of the filling operation, out of the transportable vessel and first and second pressure regulators fluidly coupled to the inlet and vent conduits, respectively.

The two pressure regulators lower the pressure of the liquid carbon dioxide in stages to a final desired pressure of about 110 psi. Specifically, the first pressure regulator lowers the pressure of the liquid carbon dioxide flowing through the inlet conduit from 300 psi to a pressure that is below the maximum service pressure of the transportable tank. This is a commonly used practice in the trade for such vessels and in this case the maximum service pressure is controlled by a relief valve set at about 250 psi. Accordingly, the first pressure regulator is selected to lower the pressure of the cryogen to approximately 175 psi, which is below the 250 psi setting stated. As such a pressure lowering causes some of the liquid carbon dioxide to flash into gaseous carbon dioxide which in turn impedes the flow of liquid cryogen to the transportable vessel, it is important that the plumbing of the system be arranged so that the transportable vessel is only a short distance downstream from the first pressure regulator. The second pressure regulator is located downstream of the transportable vessel and advantageously maintains the pressure of this vessel at about 110 psi. The resulting lowering in pressure from 300 psi to 110 psi lowers the temperature of the liquid carbon dioxide from about 0° F. to approximately −50° F. Storing liquid cryogen at this lower pressure substantially increases its capacity to remove heat because it is colder, as well as advantageously increases its density so that the transportable vessel can carry more cryogenic refrigerant. Additionally, the difference in the pressure settings of the two pressure regulators (175 psi versus 110 psi) creates enough of a pressure differential between the first and second pressure regulators to pressure feed the transportable vessel so that it may be filled in a reasonably short time.

The system of the invention further comprises a shut-off mechanism for shutting off the flow of liquid carbon dioxide into the transportable vessel when a "full" condition is sensed. The shut-off mechanism includes a liquid level sensor mounted within the transportable vessel, an electrically operated fill valve mounted within the inlet conduit, and a control circuit electrically connected to both the sensor and the valve. In the preferred embodiment, the fill valve is installed in the inlet conduit upstream of the first pressure regulator.

The system of the invention may also include a purging mechanism that purges liquid carbon dioxide from the inlet conduit at the end of a filling operation. The purging mechanism may include a second electrically controlled valve for admitting a flow of pressurized carbon dioxide gas immediately downstream of the fill valve, in combination with the previously-mentioned control circuit. In operation, after the fill valve closes, the previously mentioned control circuit opens the purge valve so that residual liquid carbon dioxide in the conduit drains into the transportable vessel. In this manner, the purging mechanism advantageously conserves liquid cryogen while preventing the formation of unwanted dry ice in the inlet conduit.

Finally, the system may include a muffler coupled to the end of the vent conduit in order to reduce the noise associated with the venting of gaseous carbon dioxide during the filling operation.

The invention also includes a method for transferring liquid carbon dioxide from the aforementioned storage vessel to a transportable vessel. The method includes the steps of conducting a flow of liquid carbon dioxide from the storage to the transportable vessel through an inlet conduit while reducing and maintaining the pressure of the liquid carbon dioxide flowing into the vessel to about 175 psi. In the next step, gaseous carbon dioxide formed as a result of the reduction in pressure is vented from the transportable vessel while maintaining a back pressure of approximately 110 psi. Finally, the flow of liquid carbon dioxide through the inlet conduit is shut off when the transportable vessel arrives at a "full" condition, and the inlet conduit is purged of liquid carbon dioxide. All during these steps, the noise generated through the vent conduit is muffled by the aforementioned outlet muffler.

Both the system and method of the invention allow an unskilled system operator to fill a transportable cryogenic vessel from a higher-pressure storage vessel in an automated operation that does not require the simultaneous manipulation of flow valves and which does not result in the unnecessary wastage of cryogenic refrigerant.

The foregoing and other aspects of the invention will become apparent from the detailed description, when considered in conjunction with the accompanying drawing FIGURE.

BRIEF DESCRIPTION OF THE DRAWING FIGURE

The drawing FIGURE is a schematic diagram of the filling system of the invention.

DETAILED DESCRIPTION OF THE PREFERRED EMBODIMENT

With reference now to the FIGURE, the filling system 1 of the invention operates to fill a transportable tank 3 of a truck-mounted cryogenic refrigeration system with liquid carbon dioxide from a storage tank 5. To this end, the system 1 includes a conduit 7 which is connected at one end to a liquid carbon dioxide outlet 9 located on the storage tank 5, and which includes a flexible hose portion 7 downstream of a pressure regulator 23. The system 1 further includes a conduit 11 which is used to purge the conduit 7 after a filling operation has been completed. The conduit 11 is connected at one end to a gaseous carbon dioxide outlet 13 of the storage tank 5.

Turning now to the components associated with the conduit 7, a solenoid-operated fill valve 17 is provided downstream of the liquid $CO_2$ outlet 9 as shown. This valve is the primary component in controlling a flow of liquid carbon dioxide from the storage tank 5 to the transportable tank 3. A filter 19 is provided downstream of the fill valve 17 in order to filter out ice and dirt from the liquid carbon dioxide flowing from the storage tank 5. Downstream of the filter 19 the conduit 7 includes a branch conduit 20 having a relief valve 21 for the prevention of an over-pressure condition.

Normally, the pressure in the conduit 7 is between 250 psi and 300 psi upstream of the first pressure regulator 23 (that is, it is the same as the pressure of the storage tank 5). However, should this pressure ever exceed a selected pressure, for example 350 psi, the relief vent valve 21, associated with the inlet conduit, will be activated, and vent off excess pressure. Such excess pressure can occur should liquid $CO_2$ get trapped in the flexible hose portion 7' between first pressure regulator 23 and tank 3.

Downstream of the relief valve 21 is the previously-mentioned liquid carbon dioxide pressure regulator 23. Pressure regulator 23 is set to maintain a pressure, lower than the activation pressure of the relief valve 21, of approximately 175 psi downstream of itself. This lower pressure (175 psi) must be lower than the 250 psi setting of a secondary relief valve 21*a* of the transportable tank 3 and must also be above the desired transportable tank pressure of about 110 psi. Pressure vessels such as the transportable tank 3 generally have one or more relief valves and other control valves. For purposes of this description, only the relief valve 21*a* with the highest pressure relief setting on this tank is shown. Downstream of the conduit pressure regulator 23 is a high-pressure cut-off switch 25. This switch is electrically connected to a control circuit 75, and is preferably set to shut off the solenoid operated fill valve 17 if the pressure in the hose portion 7' of the fill conduit 7 rises above 200 psi downstream of the valve 23. A visual pressure gauge 27 is provided on the branch conduit that interconnects the cut-off switch 25 with hose portion 7.

The remaining components connected to hose portion 7' include a manually operated bleed valve 29 for bleeding off high pressure, gaseous carbon dioxide prior to disconnecting hose portion 7' from tank 3 via hose coupling 31, a check valve 33 connected to an inlet conduit 34, and a manually operated refrigeration circuit valve 35 which allows liquid carbon dioxide to flow out of the tank 3 via conduit 34 into a cryogenic refrigeration circuit (not shown). Valve 35 is normally closed during a tank filling operation so that all the liquid carbon dioxide flows to fill tank 3.

The filling system 1 further includes a vent hose 39 connected to a vessel gas outlet conduit 37 for venting off gaseous carbon dioxide created as a result of flashing when the pressure of the liquid carbon dioxide is reduced from about 300 psi to 110 psi. Vent hose 39 includes a vent shutoff valve 41 for sealing the tank 3 shut when the hose 39 is disconnected from it via a hose coupling 43. Downstream of the coupling 43, the vent hose includes a bleed valve 44 for bleeding off high pressure carbon dioxide vent gases before hose 39 is decoupled.

Next, hose 39 includes a second pressure regulator 45 for maintaining a back pressure in the vent hose (and consequently the tank 3) of 110 psi. Pressure regulator 45 maintains the transportable tank 3 at the desired pressure of about 110 psi during the filling operation and until the transportable tank 3 is disconnected from the filling system 1. The transportable tank 3 has other control valves and relief valves (not shown) that maintain the pressure of the transportable tank at design conditions. A pressure line 47 interconnects the second pressure regulator 45 with pressurized carbon dioxide vapor from the storage tank 5 to maintain the necessary pressure differential within the regulator 45 so that it can perform its function. Vent hose 39 terminates in a muffler 49 which substantially reduces the noise associated with the venting of pressurized carbon dioxide during a filling operation when carbon dioxide gas is expelled from outlet 51. Finally, a hose manifold 52 is provided for storing the hose portion 7' and the vent hose 39 in a slight overpressure condition in a manner described in more detail hereinafter.

Turning now to a description of the components of the system 1 associated with the vapor conduit 11, it should first be noted that the conduit 11 branches off into a purge line 53 that terminates at a point immediately downstream of the solenoid operated fill valve 17. A solenoid operated purge valve 55 is provided in the purge line 53 for selectively directing pressurized $CO_2$ gas into the hose portion 7' of the fill conduit 7 downstream of the valve 17 incident to a purging operation. The other branch of the vapor conduit 11 is a filter flush line 57. Flush line 57 includes third pressure regulator 59 which reduces the pressure of the vaporous carbon dioxide from storage tank 5 down to a pressure appropriate for the flushing of the filter 19, which is 5 psi to 10 psi.

Downstream of the third pressure regulator 59 is a electrically powered heater 65. In the preferred embodiment, heater 65 preferably has a capacity of approximately 600 watts so as to raise the temperature of the carbon dioxide gas flowing in route to the filter 19 to approximately 180° F. Such a heated gas will advantageously melt water, ice or dry ice particles (if any) that have lodged in the filter 19. Additionally, when the hose portion 7' and vent hose 39 are not being used to conduct a fill operation, the heated low pressure gas continues to be conducted through the fill conduit 7 when the ends of the hoses 7' and 39 are coupled to the end of hose manifold 52. The manifold 52 in turn conducts the heated and mildly pressurized gas through the vent hose 39. The heat and positive pressure that this gas applies to both the hoses 7' and 39 in turn maintains them in an ice and dirt free condition. Downstream of the heater 65 is the check valve 67, pressure gauge 68, the previously-discussed filter 19, and a solenoid operated flush valve 69. When open, the valve 69 allows a combination of the warm carbon dioxide gas and melted ice to drain from flush outlet 71.

To ensure an automatic filling operation, the system 1 further includes a tank level sensor 73. While the level sensor 73 can assume any one of several different forms, a capacitive electronic level sensor is used in the preferred embodiment. The level sensor 73 is electronically connected to the previously-mentioned control circuit 75 via an electric line 76. In the preferred embodiment, the control circuit 75 is merely a series of relays and timers; it need not be a microprocessor as the logic used in opening and closing the solenoid-operated valves of the system 1 is very simple, and only involves a small number of valves at any one given time. As is indicated schematically in the FIGURE, the output of the control circuit 75 is connected to the solenoid-operated fill valve 17 via wire 77, to the solenoid-operated purge valve 55 via wire 78, to the electric heater 65 via electric wire 79 to actuate and deactuate the same, and to the solenoid-operated flush valve 69 via electric wire 81. Electric wires 76 and 80 connect the tank level sensor 73 and pressure switch 25 to the input of the control circuit 75.

In the first step of the operation of the system 1, the system operator attaches the fill hose 7' and vent hose 39 to the fill inlet and gas outlet of the tank 3 via hose couplings 31 respectively the system operator then makes sure that the outlet valve 35 leading to the refrigeration circuit (not shown) is closed, and that the vent shut-off valve 41 is open. He then moves the switch 25 of the control circuit 75 to a "tank fill" position wherein the circuit 75 opens the fill valve 17 while shutting purge valve 55, and flush valve 69. Liquid carbon dioxide pressurized to between 250 psi and 300 psi then flows through the fill conduit 7 through the valve 17, filter 19, and first pressure regulator 23. Pressure regulator 23 lowers the pressure of the liquid carbon dioxide from approximately 300 psi to approximately 175 psi, causing some of the carbon dioxide to flash into gas. The liquid/ gaseous carbon dioxide mixture proceeds to flow through the coupling 31, the check valve 33, and into tank 3. Gaseous carbon dioxide created by the pressure reduction is expelled through the vent hose 39 via valve 41, coupling 43, and second pressure regulator 45. From the second pressure regulator 45, the gaseous carbon dioxide vents through the sound-reducing muffler 49 and from thence through the gas outlet 51. This step of the operation continues until the level sensor 73 generates an electrical signal indicative that a "tank full"condition is eminent. This signal is conducted through the electrical wire 76 to the control circuit 75, which in turn immediately cuts off the fill valve 17 and opens the solenoid-operated purge valve 55. The opening of the valve 55 pushes into tank 3 any residual liquid carbon dioxide disposed in the fill hose 7 downstream of the valve 17 by means of gaseous carbon dioxide pressurized at between 250 psi and 300 psi reduced to 175 psi by first pressure regulator 23. The high pressure of the gaseous carbon dioxide quickly empties the hose 7 of all residual liquid carbon dioxide. Once this step of the operation is completed, bleed valves 29 and 44 are manually opened to relieve residual pressure from hose portion 7' and vent hose 39. The hoses 7' and 39 are then decoupled from couplings 31 and 43, and coupled onto the ends of the hose manifold 52 for storage.

Next, a switch on the control circuit 75 is turned to a "flush cycle" position, which will have the effect of actuating the heater 65, and opening the flush valve 69. The execution of these steps allows carbon dioxide gas heated to a temperature of approximately 180° F. to flush the filter 19 at a pressure of between 5 psi and 10 psi. Any melted water and gases flow through the solenoid-operated valve 69, and through the flush outlet 71, while heated carbon dioxide gas flows both through the filter 19 and fill conduit 7. The heater 65 may eventually be turned off by a timer if so desired. The flushing with 5 psi to 10 psi carbon dioxide gas continues to heat the system at a positive pressure to keep out dirt and moisture. While this invention has been illustrated and described in accordance with the preferred embodiment, it is recognized that variations and changes may be made therein without departing from the invention as set forth in the claims.

What is claimed is:

1. A system for transferring liquid cryogen from a higher pressure vessel having a liquid cryogen outlet and a vapor cryogen outlet, to a lower pressure vessel, the system comprising:

an inlet conduit connected between said higher and lower pressure vessels for conducting a flow of liquid cryogen from said higher pressure vessel to said lower pressure vessel, a filter being fluidly coupled to the inlet conduit;

a vapor conduit flow connected to the cryogen vapor outlet, the cryogen vapor conduit including a purge line and a flush line, the purge line being fluidly coupled to the inlet conduit upstream from the filter, said purge line for purging liquid cryogen from the inlet conduit, the flush line being fluidly coupled to the filter so that the filter may can be selectively flushed during transfer of the liquid cryogen to the transportable pressure vessel;

a vent conduit connected to said lower pressure vessel for venting gaseous cryogen out of said lower pressure vessel;

a first pressure regulator fluidly coupled to said inlet conduit for lowering the pressure of liquid cryogen entering said lower pressure vessel to a first selected pressure value to render the cryogen downstream of the first pressure regulator flow colder and denser than the cryogen upstream of the first pressure regulator;

a second pressure regulator fluidly coupled to said vent conduit for maintaining the pressure in said lower pressure vessel at a second selected pressure value while said vent conduit vents said gaseous cryogen, wherein said second selected pressure value is lower than said first selected pressure value.

2. The system as defined in claim 1, wherein said higher pressure vessel is pressurized at over 250 psi, and wherein said first pressure regulator lowers the pressure of said flow to approximately 175 psi.

3. The system as defined in claim 2, wherein said second pressure regulator maintains the pressure of said lower pressure vessel to at least 80 psi.

4. The system as defined in claim 1, wherein the higher pressure vessel is pressurized at about 300 psi, and wherein said first and second pressure regulators maintain said lower pressure vessel at a pressure of between about 175 and 110 psi.

5. The system as defined in claim 4, wherein said first and second selected pressure values are 175 psi and 110 psi, respectively.

6. The system as defined in claim 1, further comprising a muffler means fluidly connected to said vent conduit for reducing noise associated with the venting of gaseous cryogen.

7. The system as defined in claim 1, further comprising means for shutting off said flow of liquid cryogen through said inlet conduit when said lower pressure vessel is full.

8. The system as defined in claim 7, wherein said shut-off means includes a liquid level sensor for generating an electrical signal indicative of a full condition in said lower pressure vessel, an electrically operated valve for shutting off the flow of liquid cryogen in said inlet conduit, and control circuit means electrically connected to said liquid level sensor and said shut-off valve for closing said valve upon receipt of said electrical signal from said sensor.

9. The system as claimed in claim 1 further comprising a heater fluidly coupled to the flush line to selectively increase the temperature of the cryogen vapor used to flush the filter.

10. The system as claimed in claim 1 further comprising a purge line flow regulator fluidly connected to the purge line and a flush valve fluidly connected to the flush line.

11. A system for transferring liquid carbon dioxide from a higher pressure storage vessel having a carbon dioxide vapor outlet and a liquid carbon dioxide outlet to a lower pressure transportable vessel, the system comprising:

an inlet conduit connected between said liquid carbon dioxide outlet of the higher pressure storage vessel and the transportable pressure vessel for conducting a flow of liquid carbon dioxide from said storage pressure vessel to said transportable pressure vessel, a filter being fluidly coupled to the inlet conduit;

a vapor conduit flow connected to the carbon dioxide vapor outlet, the vapor conduit including a purge line and a flush line, the purge line being fluidly coupled to the inlet conduit upstream from the filter to purge the inlet conduit of liquid carbon dioxide, the flush line being fluidly coupled to the filter so that the filter can be flushed during transfer of the liquid carbon dioxide to the transportable pressure vessel;

a vent conduit connected to said transportable pressure vessel for venting gaseous carbon dioxide out of said transportable pressure vessel;

a first pressure regulator fluidly coupled to said inlet conduit for lowering the pressure of liquid carbon dioxide entering said lower pressure transportable pressure vessel to a first selected value to render said flow downstream of the first pressure regulator colder and denser than the flow upstream of the first pressure regulator;

a second pressure regulator fluidly coupled to said vent conduit for maintaining the pressure in said transportable pressure vessel at a second selected pressure value that is lower than said first selected pressure value while said vent conduit vents said gaseous carbon dioxide, and means for shutting off said liquid carbon dioxide through said inlet conduit when said transportable pressure vessel is full.

12. The system as defined in claim 11, wherein said storage pressure vessel is pressurized at over 250 psi, and wherein said first selected pressure value associated with said first pressure regulator is 190 psi or less.

13. The system as defined in claim 12, wherein said second selected pressure value associated with said second pressure regulator is at least 80 psi.

14. The system as defined in claim 12, wherein said storage pressure vessel is pressurized to about 300 psi, and wherein said first and second selected pressure values associated with said first and second pressure regulators are 175 psi and 125 psi, respectively.

15. The system as defined in claim 11, further comprising a muffler means fluidly connected to said vent conduit for reducing noise associated with the venting of gaseous carbon dioxide.

16. The system as defined in claim 11, wherein said shut-off means includes a liquid level sensor for generating an electrical signal indicative of a full condition in said transportable pressure vessel, an electrically operated valve for shutting off the flow of liquid carbon dioxide in said inlet conduit, and control circuit means electrically connected to said liquid level sensor and said shut-off valve for closing said valve upon receipt of said electrical signal from said sensor.

17. The system as claimed in claim 11 further comprising a heater fluidly coupled to the flush line to selectively increase the temperature of the carbon dioxide vapor used to flush the filter.

18. The system as claimed in claim 11 further comprising a purge line flow regulator fluidly connected to the purge line and a flush valve fluidly connected to the flush line.

19. The system as claimed in claim 10 further comprising a heater fluidly coupled to the flush line, the system further comprising a control circuit electrically connected to the purge line flow regulator, heater and the flush valve, said control circuit for selectively actuating the purge line regulator, flush valve and heater during transferral of the liquid cryogen.

20. The system as claimed in claim 18 further comprising a heater fluidly coupled to the flush line, the system further comprising a control circuit electrically connected to the purge line flow regulator, heater and the flush valve, said control circuit for selectively actuating the purge line regulator, flush valve and heater during transferral of the liquid carbon dioxide.

21. A method for transferring liquid carbon dioxide from a higher pressure vessel to a lower pressure vessel through an inlet conduit flow connecting the pressure vessels, the lower pressure vessel including a vent conduit, and muffler means fluidly connected to the vent conduit, the method comprising the steps of:

introducing liquid carbon dioxide through the inlet conduit from said storage vessel into said transportable vessel while simultaneously substantially lowering the pressure of said liquid carbon dioxide to a pressure greater than 80 psi in order to render said liquid carbon dioxide colder and denser, and venting gaseous carbon dioxide that is formed as a result of said lowering of the pressure of liquid carbon dioxide entering the lower pressure vessel by conducting said gaseous carbon dioxide out of said lower pressure vessel through a vent conduit, pressure regulator means which maintains the pressure in the lower pressure vessel at least 80 psi, and flowing the vented gaseous carbon dioxide through muffler means to reduce the noise generated by venting the gaseous carbon dioxide.

22. The method as claimed in claim 21, the inlet conduit having a filter fluidly connected to the inlet conduit, the high pressure vessel having a vapor outlet, and the vapor conduit further comprising a purge line and a flush line, the purge line being fluidly coupled to the inlet conduit upstream from the filter, said purge line for purging liquid cryogen from the inlet conduit, the flush line being fluidly coupled to the filter, the method comprising the additional step of selectively flushing the filter during transfer of the liquid cryogen to the transportable pressure vessel.

23. The method as claimed in claim 22 wherein the flush line includes a heater fluidly connected to the flush line, the method comprising the step of actuating the heater when the filter is flushed.

24. The method as claimed in claim 22 comprising the additional step of opening the purge line to purge the inlet conduit of liquid carbon dioxide.

* * * * *